United States Patent [19]

Montgomery

[11] 3,990,607

[45] Nov. 9, 1976

[54] GASOLINE DISPENSING CONTROL APPARATUS

[75] Inventor: William G. Montgomery, Seymour, Ind.

[73] Assignee: Kocolene Oil Corporation, Seymour, Ind.

[22] Filed: Jan. 21, 1976

[21] Appl. No.: 650,885

[52] U.S. Cl. ..... 222/33; 222/76

[51] Int. Cl.[2] ..... B67D 5/26

[58] Field of Search ..... 222/23, 24, 30, 37, 222/32–35, 52, 76, 153

[56] References Cited

UNITED STATES PATENTS 3,448,895 6/1969 Mesh ..... 222/34

3,858,758 1/1975 May ..... 222/34

*Primary Examiner*—Stanley H. Tollberg
*Assistant Examiner*—H. Grant Skaggs
*Attorney, Agent, or Firm*—Woodard, Weikart, Emhardt & Naughton

[57] ABSTRACT

Disclosed is an attachment for the control component of a conventional gasoline dispensing apparatus which interposes in the circuit controlling the energization of the gasoline pump a relay controlled circuit which requires momentary closure of a key-operated switch before normal operation of the pump can be reinitiated after a dispensing operation.

3 Claims, 4 Drawing Figures

GASOLINE DISPENSING CONTROL APPARATUS

BACKGROUND OF THE INVENTION

The introduction of self-service to the gasoline marketing segment of the oil industry, as a cost-saving factor, has been accelerated by recent oil shortages. One problem that has slowed its use, however, is the cost of new equipment heretofore thought necessary to provide for self-service operation.

Essentially self-service operation requires a means for monitoring each dispensing cycle of the gasoline pump to assure that a dispensing operation cannot be started without interposition of some signal to the equipment. Such a signal can be provided by insertion and turning of a key-operated switch or by otherwise actuating a manual switch either at the gasoline dispensing device or at a remote console where several pumps or dispensing devices are being monitored.

The concept of the present invention is to provide an apparatus for converting or modifying existing gasoline pumping or dispensing devices to provide self-service operation. The apparatus consists of two electromagnetic relays, a key-operated switch and a relay lamp. These are interconnected so that they may be interposed in the conventional reset circuit of the gasoline pump or dispensing apparatus. Only a minimum number of adapting connections need be made to the pump reset circuit and these are substantially the same for both remote submerged pump installations and self-contained units.

DESCRIPTION OF THE PREFERRED EMBODIMENTS

Figure 1:
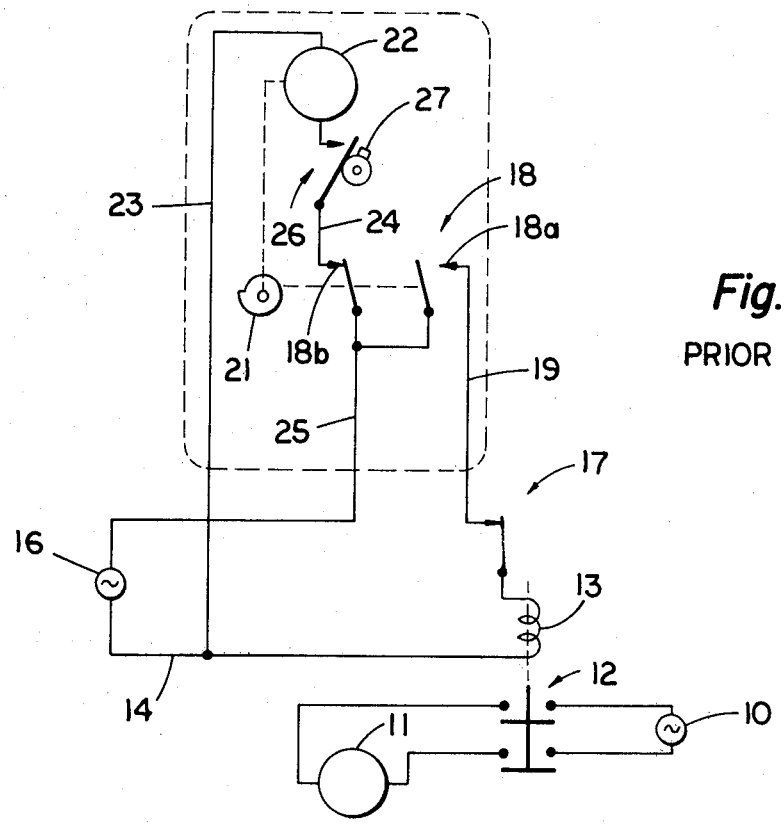
Fig. 1 PRIOR ART
FIG. 1 is a schematic, simplified showing of the circuit used in prior art gasoline dispensing apparatus.

Referring to FIG. 1 there is shown a general circuit arrangement which is conventional in the prior art and includes wiring connecting a source of electrical power 10 with an electrically driven pump 11 which may be located at the dispensing apparatus or remotely therefrom. Application of power to the pump is controlled by the contacts 12 of an electromagnetic contactor whose operating coil is indicated at 13. A wire 14 connects an alternating current source of control power 16 to one side of the coil 13. The other side of the coil may be connected through an auxiliary safety control switch 17 and through the reset motor operated switch contacts 18, this connection being accomplished through wire 19. A wire 25 joins one side of the normally open, reset motor operated switch 18 to the other side of the electrical power source 16. The switch 18 is provided with normally open contacts **18*a* and normally closed contacts 18*b* and is moved through an opening and closing cycle by rotation of a cam 21 shown in simplified, schematic form. The cam is rotated through its cycle by an electrical reset motor 22, one side of which is connected to the wire 14 by means of a wire 23. The other side of the reset motor is connected by means of the wire 24 to the normally closed contacts 18*b* and interposed in this connection is a normally open switch 26 which is moved to closed position by a moveable abutment 27. The abutment 27 is rotated to actuate the switch 26 by the start switch actuator or external arm (not shown) which is located on the exterior of the dispensing equipment near the nozzle stowing aperture on many dispensing pumps. The actuating arm is moved to rotate the member 27 closing switch 26. When the nozzle is replaced in the stowing aperture after a pumping operation, the external arm, and thus member 27, are moved back to their position of FIG. 1 again opening the switch 26.**

It will be understood that the structure described above and shown in FIG. 1 is a simplified form of a conventional dispensing circuit and, in operation, when gasoline is to be dispensed the exterior switch arm controlling the position of member 27 is actuated closing switch 26. This starts the reset motor which rotates member 21 and functionally resets the computer indicator numerals back to zero from the preceding pumping operation, resets the volume indicator to zero and, near the end of its cycle, opens the switch **18*b* and closes switch 18*a*. This places the apparatus in the dispensing mode. Opening of switch 18*b* again deenergizes the reset motor 22 and closure of switch 18*a* provides electrical continuity to the contactor coil 13, assuming the control switch 17 is closed. Energization of the contactor 13** starts the pump and the gasoline delivery is initiated by actuating the manual valve in the delivery nozzle.

Figure 2:
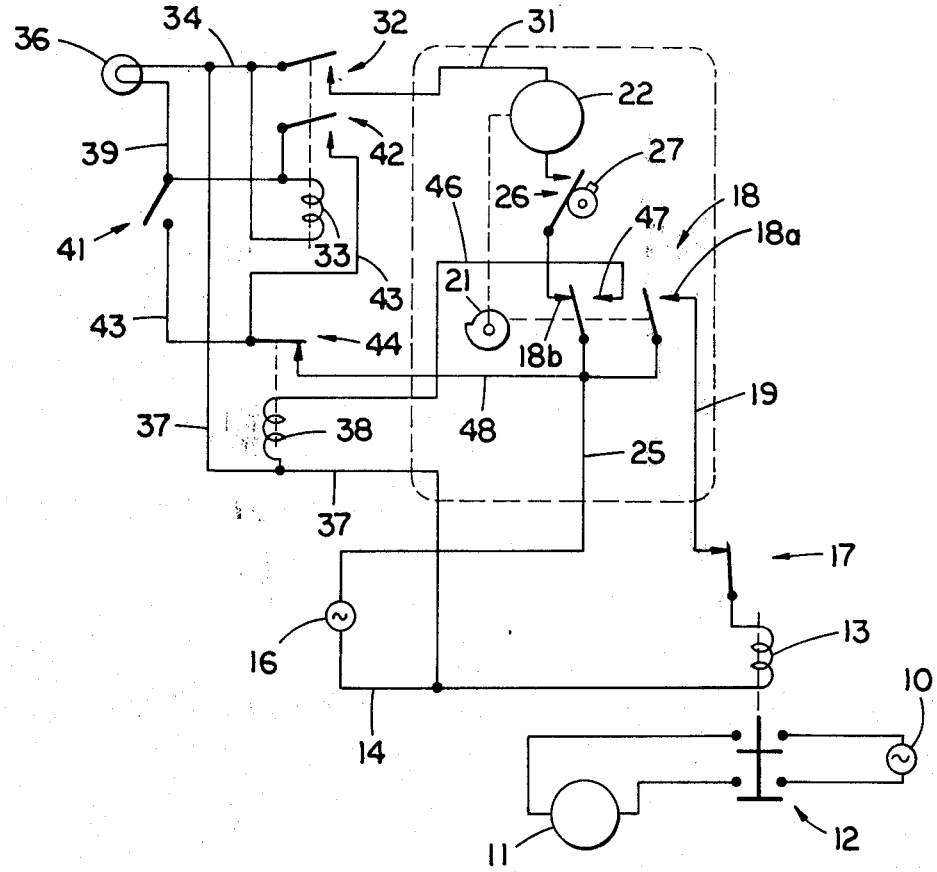
FIG. 2 is a schematic view of the circuit shown in FIG. 1 but modified by the incorporation of the adapting apparatus of the present invention.

Referring to FIG. 2, the circuit disclosed in FIG. 1 is there generally duplicated except for the interconnection of the adapting apparatus of the present invention. In FIG. 2 the reset motor 22 is connected by means of a wire 31 to one of the normally open contacts 32 operated by a first relay coil 33. A wire 34 connects the other of the normally open contacts 32 to a signal means which may take the form of a ready light 36. A wire 37 also connects the wire 34 to one side of a second relay coil 38 and the wire 37 terminates at its connection to the wire 14, that is, to one side of the control power source 16. A wire 39 extends from the lamp 36 to one side of a normally open, key-operated switch 41, the wire 39 continuing to one side of the relay coil 33 and to one side of the normally open relay operated, hold-in contacts 42. The opposite side of the key switch 41 is connected by means of wire 43 to the contacts 42 and is also connected to one side of a normally closed relay coil operated switch 44, the switch 44 being moved to open position upon energization of the relay coil 38. A wire 46 connects the relay coil 38 to the normally open side 47 of the reset motor operated switch 18. A wire 48 connects the normally closed switch 44 with the wire 25, that is, to the other side of the control power source 16. As will be evident from comparing FIGS. 1 and 2, the change in the connection of wire 23 (its counterpart in FIG. 2 being the wire 37), the insertion of wire 48, the addition of wire 46 and contact 47 and the insertion of wire 31 represent the only circuit changes in the conventional circuit of FIG. 1 necessary to provide the self-service adaptation of FIG. 2.

Figure 4:
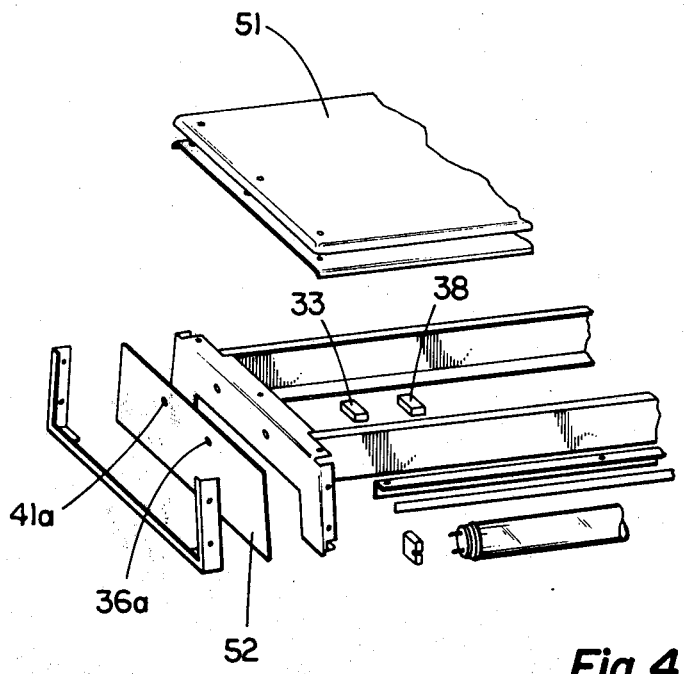
FIG. 4 is a fragmentary, perspective, exploded view of a portion of the pumping apparatus showing one possible physical location for the components shown in FIG. 2.

In FIG. 4 there is shown one possible physical location for the relays 33 and 38, the ready lamp 36 and the key-operated switch 41. These components may all be located adjacent the top cap 51 of the conventional dispensing structure. The key-operated switch may be accessible through an aperture 41*a* in the side panel 52 of the pump structure. Correspondingly, the ready lamp 36 would be visible through the aperture 36*a* in the panel 52 when assembled on the pump or dispensing device. Alternatively the components mentioned above may all be located in a separate housing mounted on or adjacent to the pump or dispensing device.

In operation referring to FIG. 2, the key switch 41 is momentarily closed by insertion of the key and this energizes the ready lamp 36 through wire 37, wire 39, switch 41, wire 43, switch 44 and through wires 48 and 25. Relay coil 33 is also then energized through wire 37, wire 34, relay coil 33, switch 41, wire 43, switch 44, wire 48 and wire 25. Closure of relay operated switch 42 provides a hold-in circuit for the relay coil 33 which by-passes the key switch 41, this hold-in circuit being through wire 39, switch 42 and wire 43. Closure of relay switch 32 provides power through wires 37, 34, switch 32 and wire 31 to one side of the reset motor 22. The energizing circuit for the reset motor 22 is then complete except for the open switch 26, the ready lamp 36 and the relay coil 33 remaining energized with the dispensing apparatus now ready for a dispensing operation.

Since the adaptor circuit has now readied the reset motor for operation, the initiation of dispensing of the gasoline from the pump requires closing the switch 26 by actuating the exterior mounted lever arm. The sequence of operations which occurs upon manual closure of the switch 26 starts with the energization of reset motor 22. As mentioned with reference to FIG. 3, the reset motor thereupon moves through its cycle resetting the computer indicator numerals back to zero and resetting the volume indicator to zero. Near the end of its cycle a cam 21, moved by the reset motor 22, opens the contact 18*b* and closes the normally open contact 47. Contacts 18*a* are also moved to closed position. Closure of contacts 18*a* provides power to the contactor coil 13 which will be energized, assuming control switch 17 is closed, to apply power to the pump 11, the energizing circuit for the coil 13 being through wire 25, switch 18*a* and wire 19. With the closure of switch contacts 47 relay coil 38 is energized through wire 25, through switch 47, wire 46 and wire 37. Energization of relay coil 38 opens normally closed relay operated switch contacts 44 and breaks the circuit through wire 43 and relay contact 42 which have maintained energization of relay coil 33. Relay coil 33 thereupon returns switches 42 and 32 to their normally open positions deenergizing ready lamp 36 and deenergizing the reset motor 22.

The dispensing operation may now be initiated by manually actuating the nozzle valve (not shown). With the contactor coil 13 energized through wire 25, switch contacts 18*a* and wire 19, the contacts 12 will be closed supplying electrical power to the pump 11. At the conclusion of the dispensing function the nozzle valve is released to close and the nozzle returned to the stowed position. Switch 26 is reopened by manipulation of the external lever arm controlling the member 27 and by a mechanical connection, not shown, between the member 27 and the cam 21, the cam is advanced to its initial position opening switch 47, reclosing contacts 18*b* and opening switch 18*a*. The next dispensing operation cannot begin until the key-operated switch is again momentarily closed and the switch 41 thus functions as a locking switch whose actuation is necessary at the start of each dispensing operation of a pump.

Figure 3:
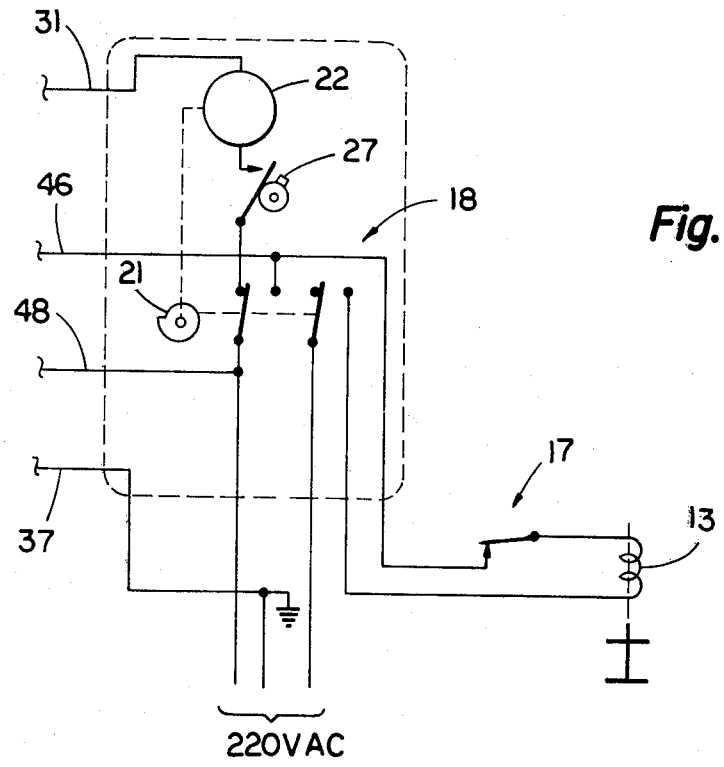
FIG. 3 is a fragmentary, schematic view showing the apparatus of the present invention incorporated into a modified form of the control apparatus.

Referring to FIG. 3 there is fragmentarily shown the connections to the pump control circuit which are utilized when a 220 volt alternating current, three wire source of power is utilized. In FIG. 3 the same reference numerals are utilized to indicate components the same as those in FIG. 2.

While the invention has been disclosed and described in some detail in the drawings and foregoing description, they are to be considered as illustrative and not restrictive in character, as other modifications within the scope of the invention may readily suggest themselves to persons skilled in the art.

I claim:

1. In a gasoline dispensing control apparatus of the type having a source of electrical power (16) connected in parallel across both a reset motor (22) operable through a resetting cycle and a controller (13) adapted to energize a gasoline pumping motor (11), a first normally open manual switch (26) and a first normally closed reset motor operated switch (18*b*) interposed in series between one terminal of said motor and said power source and a second normally open reset motor operated switch (18*a*) interposed between said power source and said controller and closed by said reset motor at the termination of its resetting cycle, the improvement comprising: a dispensing monitoring control attachment interposed between the other terminal of said reset motor and said source of power, said attachment comprising a key-operated normally open switch (41), an electrically energized signal means (36), a first (33) and second (38) electromagnetic relay coil, two normally open relay switches (32, 42) operated by said first relay coil and a normally closed relay switch (44) operated by said second relay coil, circuit means connecting one of said normally open relay switches between said power source and the other terminal of said reset motor, said key switch being connected between said first relay coil and said source of power and between said signal means and said source of power to provide an initial energizing circuit for said first relay coil, said other normally open relay switch providing a hold-in circuit between said power source and said first relay coil and signal means which by-passes said key switch, said normally closed relay switch being interposed in both said initial energizing circuit and said hold-in circuit, and circuit means providing an energizing circuit for said second relay coil completed when said first normally closed reset motor operated switch is opened by said reset motor, whereby momentary closure of said key-operated switch permits initiation of a gasoline pumping operation by said pump at the termination of said reset cycle, but prevents initiation of the next reset cycle until said key switch is again momentarily actuated to closed position.

2. An improved gasoline dispensing control device as claimed in claim 1 in which said signal means takes the form of a ready light.

3. An improved gasoline dispensing control device as claimed in claim 1 in which said normally closed relay switch opens the circuit to said signal means when said second relay coil is energized.

* * * * *